US007008301B1

(12) United States Patent
Raeder

(10) Patent No.: US 7,008,301 B1
(45) Date of Patent: Mar. 7, 2006

(54) POLISHING UNIFORMITY VIA PAD CONDITIONING

(75) Inventor: Christopher H. Raeder, Austin, TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 660 days.

(21) Appl. No.: 09/383,876

(22) Filed: Aug. 26, 1999

(51) Int. Cl.
*B24B 1/00* (2006.01)

(52) U.S. Cl. ..... 451/56; 451/443; 451/285

(58) Field of Classification Search ..... 451/56, 451/443, 444, 446, 285, 286, 287, 41
See application file for complete search history.

(56) References Cited

U.S. PATENT DOCUMENTS 5,547,417 A * 8/1996 Breivogel et al. ..... 451/58
5,605,499 A * 2/1997 Sugiyama et al. ..... 451/443
5,664,987 A * 9/1997 Renteln ..... 451/21
5,779,521 A * 7/1998 Muroyama et al. ..... 451/56
5,868,605 A * 2/1999 Cesna ..... 451/41
6,093,651 A * 7/2000 Andideh et al. ..... 438/692
6,113,462 A * 9/2000 Yang ..... 451/5
6,227,947 B1 * 5/2001 Hu et al. ..... 451/56
6,254,456 B1 * 7/2001 Kirchner et al. ..... 451/41
6,276,989 B1 * 8/2001 Campbell et al. ..... 451/10

* cited by examiner

*Primary Examiner*—Dung Van Nguyen
(74) *Attorney, Agent, or Firm*—Crawford Maunu PLLC

(57) ABSTRACT

According to an example embodiment, the present invention is directed to a CMP apparatus having a polishing table, a wafer carrier adapted to carry a wafer on a pad, and a conditioning wheel. If the pad is being polished in a center-fast or center-slow manner, the conditioning wheel is used to condition the pad and to improve the center-fast or center-slow condition. Benefits of using this embodiment include improved wafer quality, improved pad life, a reduction in defective wafers, and faster production.

18 Claims, 3 Drawing Sheets

POLISHING UNIFORMITY VIA PAD CONDITIONING

FIELD OF THE INVENTION

The present device relates generally to semiconductor devices and their fabrication and, more particularly, to chemical-mechanical polishing (CMP) tools for manufacturing and analyzing semiconductor devices.

BACKGROUND OF THE INVENTION

The electronics industry continues to rely upon advances in semiconductor manufacturing technology to realize higher-functioning devices while improving reliability and cost. For many applications, the manufacture of such devices is complex, and maintaining cost-effective manufacturing processes while concurrently maintaining or improving product quality is difficult to accomplish. As the requirements for device performance and cost become more demanding, realizing a successful manufacturing process becomes more difficult.

The increased complexity of semiconductor devices has lead to certain disadvantageous developments including uneven device surfaces, which become more prominent as additional levels are added to multilevel-interconnection schemes and circuit features are scaled to submicron dimensions. Typically, each level within the device is patterned, resulting in a surface with varied step-heights where metal forming the pattern remains on the surface.

Planarization is a term describing the surface geometry of a semiconductor device. Complete planarization occurs when the surface of the dielectric is flat, as in a plane. No planarization occurs when the surface of the dielectric directly models the surface of the metal pattern in the layer underneath. The degree of planarization refers to the degree to which the varied surface geometry can be planarized, or smoothed out into a planar surface. Varied surface geometry is often undesirable. Therefore, as additional layers are formed within devices, the required degree of planarization increases.

A commonly-used planarization process in semiconductor device manufacturing is chemical-mechanical polishing, or CMP. CMP is useful in the planarization of silicon wafers and of VLSI circuits between different manufacturing processes. CMP is a popular planarization method, due in part to its usefulness in the global planarization of semiconductor devices. Traditional planarization processes are restricted to effecting local planarity or topographical variation on a small scale, whereas CMP is often useful on a global scale greater than about ten microns, depending upon the CMP tool being used.

A CMP tool commonly includes a table for securing a wafer-polishing pad with a semiconductor wafer in a wafer holder arranged opposite the wafer-polishing pad. Typically, the wafer is located face-down on the polishing pad, and both the polishing pad and the wafer holder rotate. A slurry, typically including $SiO_2$ particles, is applied using a wand feeding to the wafer holder and pad. The rate of removal of material from the wafer is a combination of chemical and mechanical rates. The mechanical removal rate is roughly proportional to the pressure and the relative velocity of the wafer. The chemical removal rate is a function of the size of the slurry particles and the slurry solution pH.

In addition to the use of slurry in the CMP process, a conditioner is typically used for conditioning the polishing pad. The conditioner aids in the CMP polishing process and contributes to the longevity of the pad.

A problem arises in connection with CMP processing when the rotating wafer carrier is in a position, relative to the rotating pad, that is considered center-offset. For example, the center-offset condition may include center-fast or center-slow conditions. The wafer carrier is in a position that is center-fast relative to the rotating pad when the center of the wafer is polished at a higher rate than the outer regions of the wafer. The wafer carrier is in a position that is center-slow relative to the rotating pad when the center of the wafer is polished at a lower rate than the outer regions of the wafer. The disparity in polishing rate of a wafer is attributable to non-uniform conditions. For example, the polish rate increases with increased pressure, increased slurry, or increased heat. When the wafer carrier is in a position relative to the rotating pad that results in higher pressure, higher heat, or increased slurry at the center of the wafer, the polish rate near the center increases relative to the polish rate near the edge.

In the past, these center-fast and center-slow conditions have been addressed by monitoring a set of wafers after each CMP run. For example, in connection with a CMP tool adapted to polish five wafers simultaneously, a run of five wafers would be polished and then inspected to determine whether they were experiencing a center-fast or a center-slow state. Upon detecting a center-fast or a center-slow state, the oscillation amplitude was adjusted to compensate.

The consequences of center-fast or center-slow conditions can be severely disadvantageous. These conditions can result in damage to the pad and/or wafers processed using the pad; such damage includes, for example: long arc type scratches and shallow micro-scratches, die thickness variation, and the die containing residual slurry particles. Such damage can result in a wafer yield lost. Moreover, with the material and labor cost of each pad being in the hundreds of dollars, excessive occurrences of pad replacements can be a significant detriment.

SUMMARY OF THE INVENTION

The present invention involves methods and arrangements directed to improving the CMP process, the improvements including but not limited to an expeditious CMP process, reduced maintenance to the CMP tool, enhanced pad wear, and increased wafer yield. The present invention is exemplified in a number of implementations and applications, some of which are summarized below.

According to an example embodiment, the present invention is directed to a method for chemical-mechanical polishing a wafer. A CMP arrangement having a polishing table and a wafer carrier adapted to carry a wafer relative to the center of the polishing table is used to polish the wafer. The pad is conditioned as a function of determining that the wafer is being polished in the center-offset manner. By using this method, the negative effects associated with center-offset polishing are diminished.

According to another example embodiment, the present invention includes a CMP polishing arrangement having a polishing pad, a wafer carrier, and a conditioning device. The wafer carrier is arranged to carry a wafer, rotate, and hold the wafer face-down on a polishing pad arranged to rotate and polish the wafer. A detection arrangement is adapted to detect whether the wafer is being polished in a center-offset manner. The conditioning device is arranged to condition the pad in response to the detection arrangement.

The above summary of the present invention is not necessarily intended to describe each illustrated embodiment or every implementation of the present invention. The figures and detailed description which follow more particularly exemplify these embodiments.

BRIEF DESCRIPTION OF THE DRAWINGS

The invention may be more completely understood in consideration of the following detailed description in connection with the accompanying drawings, in which.

Figure 1:
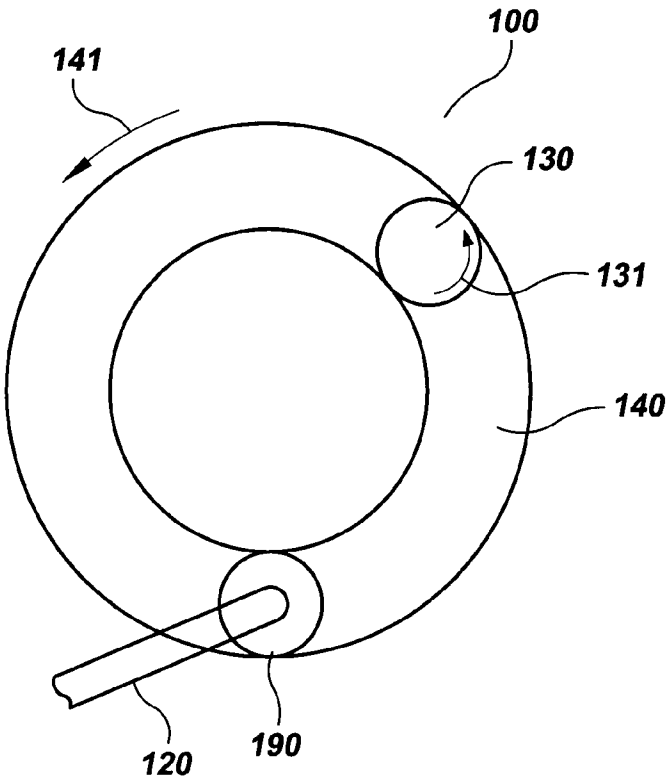
FIG. 1 shows a top view of an arrangement for a CMP process for polishing a semiconductor wafer, according to an example embodiment of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION

The present invention is directed toward a new method for chemical-mechanical polishing (CMP) that improves the ability to obtain a uniform polish-rate of semiconductor wafers, longer life of the polishing pads used in the chemical-mechanical polishing process, faster throughput of semiconductor wafers, and reduced defects. According to an example embodiment of the present invention, a semiconductor wafer is arranged in a wafer carrier of a CMP apparatus having, in addition to the wafer carrier, a polishing table including a pad and a conditioning device, such as a conditioning wheel. The semiconductor wafer is polished and it is determined whether the polishing is proceeding in a center-offset manner such as center-fast or center-slow. For instance, one method for detecting whether the wafer is being polished in a center-offset manner is to remove the wafer from the carrier and measure the thickness across the wafer using a device such as a pair of calipers. The conditioning device is arranged over the pad and relative to the center of the polishing table as a function of whether the wafer is being polished in a center-offset manner and the pad is conditioned. In this manner, negative aspects of center-fast or center-slow polishing are addressed.

Figure 2:
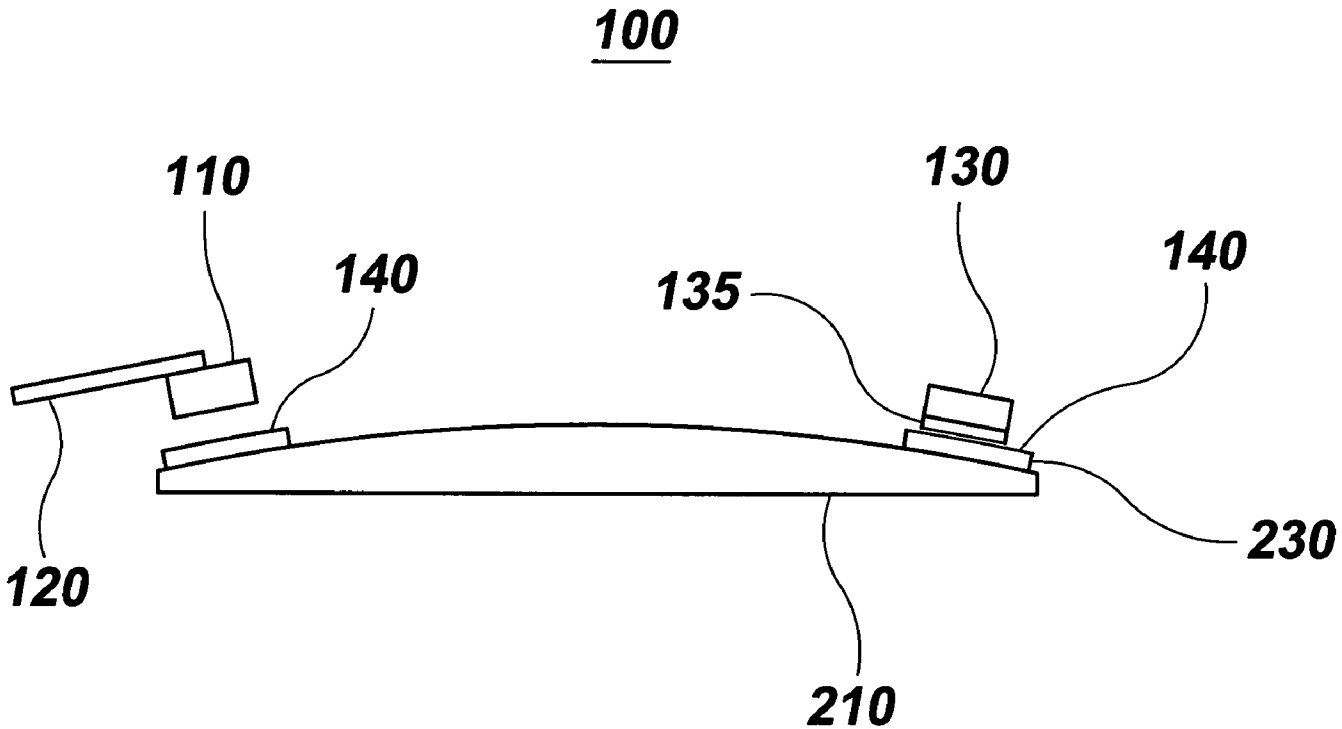
FIG. 2 shows a cut-away side view of an arrangement for a CMP process for polishing a semiconductor wafer, according to another example embodiment of the present invention.

FIG. 1 shows a top view and FIG. 2 shows a side view of a CMP arrangement 100, according to another example embodiment of the present invention. The CMP arrangement includes a polishing table 210 having a polishing pad 140. The polishing table 210 is capable of rotation, such as shown by directional arrow 141. A wafer carrier 130 is arranged over the pad and adapted to carry a semiconductor wafer 135 and bring it in contact with the pad 140 for polishing. Although FIG. 1 shows the wafer carrier 130 located directly over the pad 140, the wafer carrier 130 may be located with only a portion of the carrier 130 over the pad 140 in orders to enhance the application of the present invention. FIG. 2 shows the wafer carrier 130 (along with wafer 135) misaligned over and with respect to the center of the pad 140. The wafer is further arranged to rotate, such as shown by directional arrow 131. Conditioning wheel 110 is arranged over the pad 140 and used to condition the pad, responsive to detecting center-offset polishing. Supply 120 is used to supply conditioning materials such as water or de-ionized water to the pad 140.

In another example implementation of the present invention, conditioning wheel 110 is further arranged relative to the center of the polishing table as a function of the detection of a center-fast condition, a center-slow condition, or the detection of neither a center-fast nor a center-slow condition. For example, although FIG. 1 shows the conditioning wheel arranged generally over the pad, the wheel may be arranged closer to the center, or closer to the edge of the pad 140. In addition, although shown by way of illustration in FIG. 1 as a wheel, the conditioning wheel 110 may include other types of pad conditioning devices.

Figure 3:
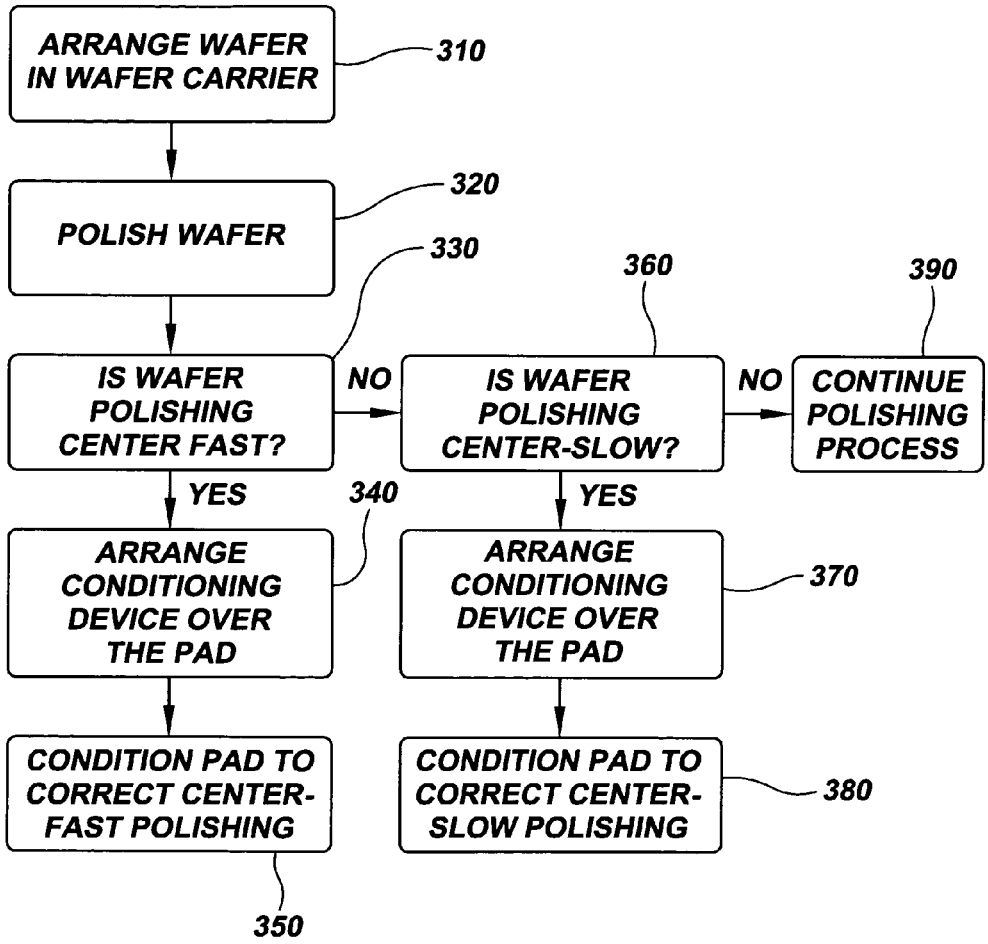
FIG. 3 is a flow chart for a method for polishing a semiconductor wafer, according to another example embodiment of the present invention.

FIG. 3 shows a flow diagram for a CMP method for addressing center-fast and center-slow polishing, according to another example embodiment of the present invention. The CMP method includes the use of a CMP apparatus having a table, a polishing pad, a wafer carrier and a conditioning device. A wafer is arranged in the wafer carrier at block 310, brought in contact with the pad and polished at block 320. If it is determined that the wafer is being polished in a center-fast manner at block 330, the conditioning device is arranged over the pad at block 340 and the pad is conditioned to correct center-fast polishing at block 350. If the wafer is not being polished in a center-fast manner at block 330, it is determined whether the wafer is being polished in a center-slow manner at block 360. If the wafer is being polished in a center-slow manner, the conditioning device is arranged over the pad at block 370 and the pad is conditioned to correct center-slow polishing at block 380. If the wafer is not being polished in a center-slow manner, the polishing process is continued at block 390.

In a more particular example embodiment of the present invention, the conditioning device is arranged relative to the center of the polishing table in order to reduce the thickness of the polishing pad. When a particular portion of the polishing pad is thicker than the rest of the pad, that portion places greater pressure upon a wafer being polished, increasing the polish rate in that portion. By reducing the thickness, the polish rate is reduced at the thinned portion of the pad. Using this embodiment in connection with the discovery of a center-fast or a center-slow polishing condition, the pad can be thinned in the region of the pad that is polishing faster. In doing so, the pressure on the wafer from that region is reduced, and the polish rate decreases due to the reduction in pressure.

For example, FIG. 2 shows a pad 140 that has been thinned near the edge 230. The thickness at the center of the pad is greater than the thickness near the edge 230 of the pad 140. When a wafer 135 is held against the pad 140 having the edge 230 thinned, the center of the wafer 135 can be held at a location of the pad 140 having greater thickness than the edge 230. Due to the greater thickness near the center, the wafer 135 is polished center-fast. Alternatively, the center of the pad 140 could be thinned resulting in the edge having a greater thickness relative to the center thickness prior to thinning and enhancing center-slow polishing. In another alternative, various portions of the pad 140 could be thinned.

While the present invention has been described with reference to several particular example embodiments, those skilled in the art will recognize that many changes may be made thereto. For example, many features of the above embodiments are combinable in a single conditioner arrangement and/or conditioning process. Such changes do not depart from the spirit and scope of the present invention, which is set forth in the following claims.

What is claimed is:

1. A method for chemical-mechanical polishing a wafer using a CMP apparatus having a polishing table including a polishing pad and a wafer carrier adapted to carry a wafer relative to the center of the polishing table, the method comprising:

using the polishing pad, polishing the wafer at a position relative to the center;

determining that the wafer is being polished in a center-offset manner; and as a function of the wafer being polished in the center-offset manner, conditioning the pad and positioning the wafer carrier misaligned with respect to the pad.

2. A method for chemical-mechanical polishing, according to claim 1, wherein the center-offset manner includes at least one of: a center-fast or center-slow manner, and further including inspecting a wafer during the polishing process.

3. A method for chemical-mechanical polishing, according to claim 1, wherein the wafer is being polished in a center-fast manner, and further including arranging a conditioning wheel over the pad and relative to the center of the polishing table.

4. A method for chemical-mechanical polishing, according to claim 3, wherein arranging the conditioning wheel comprises thinning the center of the pad.

5. A method for chemical-mechanical polishing, according to claim 1, wherein the wafer is being polished in a center-slow manner, and further including arranging a conditioning wheel over the pad and relative to the center of the polishing table.

6. A method for chemical-mechanical polishing, according to claim 5, wherein arranging the conditioning wheel comprises thinning the edge of the pad.

7. A method for chemical-mechanical polishing, according to claim 1, wherein conditioning the pad comprises altering the thickness of the pad in at least one location.

8. A method for chemical-mechanical polishing, according to claim 7, wherein altering the thickness of the pad comprises thinning the pad in at least one location where the pad is thick relative to the rest of the pad.

9. A method for chemical-mechanical polishing, according to claim 7, wherein altering the thickness of the pad comprises applying increased pressure to a portion of the pad with a conditioning wheel.

10. A method for chemical-mechanical polishing a wafer, according to claim 1, wherein positioning the wafer carrier misaligned with respect to the pad includes positioning the wafer carrier offset relative to a center of the pad.

11. A method for chemical-mechanical polishing, a wafer using a CMP apparatus having a polishing table including a polishing pad and a wafer carrier adapted to carry a wafer relative to the center of the polishing table, the method comprising:

using the polishing pad, polishing the wafer at a position relative to the center;

determining that the wafer is being polished in a center-offset manner including removing the wafer from the carrier and manually inspecting a wafer; and as a function of the wafer being polished in the center-offset manner, conditioning the pad and positioning the wafer carrier misaligned with respect to the pad.

12. An arrangement for chemical-mechanical polishing a wafer, the arrangement comprising:

means for polishing a wafer;

means for holding a wafer face-down on the means for polishing;

means for determining whether the wafer is polishing in a center-offset manner; and means, responsive to the determination means, for conditioning the polishing means and positioning the wafer misaligned with respect to the polishing means.

13. An arrangement for chemical-mechanical polishing, the arrangement comprising:

a polishing pad arranged to rotate;

a wafer carrier arranged to carry a wafer, rotate, and hold the wafer face-down on the polishing pad;

a detection arrangement adapted to detect whether the wafer is polishing in a center-offset manner; and a conditioning device adapted to condition the pad, both the conditioning device being arranged, and the wafer carrier being misaligned, relative to the polishing pad as a function of the wafer having been polished in a center-offset manner.

14. An arrangement for chemical-mechanical polishing, according to claim 13, further comprising a supply arranged to supply conditioning material to the polishing pad.

15. An arrangement for chemical-mechanical polishing, according to claim 14, wherein the conditioning material is supplied responsive to the detection arrangement.

16. An arrangement for chemical-mechanical polishing, according to claim 15, wherein the conditioning material comprises water.

17. An arrangement for chemical-mechanical polishing a wafer, according to claim 13, wherein the wafer carrier is offset relative to a center of the pad.

18. A system for chemical-mechanical polishing a wafer, using a CMP apparatus having a polishing table including a polishing pad and a wafer carrier adapted to carry a wafer relative to the center of the polishing table, the method comprising:

means for using the polishing pad, polishing the wafer at a position relative to the center;

means for determining that the wafer is being polished in a center-offset manner;

means for compensating for the wafer being polished in a center-offset manner by conditioning the pad as a function of the wafer being polished in the center-offset manner, and positioning the wafer carrier misaligned with respect to the pad.

* * * * *